US008468920B2

(12) United States Patent
Hagleitner

(10) Patent No.: US 8,468,920 B2
(45) Date of Patent: Jun. 25, 2013

(54) BLADE GUIDE FOR A DEVICE FOR DISPENSING OF PAPER SECTIONS

(76) Inventor: Hans Georg Hagleitner, Zell Am See (AT)

( * ) Notice: Subject to any disclaimer, the term of this patent is extended or adjusted under 35 U.S.C. 154(b) by 336 days.

(21) Appl. No.: 12/821,267

(22) Filed: Jun. 23, 2010

(65) Prior Publication Data

US 2010/0327003 A1 Dec. 30, 2010

(30) Foreign Application Priority Data

Jun. 23, 2009 (AT) ..... A 968/2009

(51) Int. Cl.
*B23D 25/02* (2006.01)

(52) U.S. Cl.
USPC ..... 83/337; 83/649

(58) Field of Classification Search
USPC ..... 83/335, 336, 337, 338, 648, 650, 83/649
See application file for complete search history.

(56) References Cited

U.S. PATENT DOCUMENTS

| | | | | |
|---|---|---|---|---|
| 4,186,633 | A | 2/1980 | Baumann et al. | |
| 4,188,844 | A * | 2/1980 | DeLuca | 83/337 |
| 4,441,392 | A * | 4/1984 | DeLuca | 83/337 |
| 4,712,461 | A | 12/1987 | Rasmussen | |
| 4,846,035 | A * | 7/1989 | Granger | 83/337 |
| 5,937,718 | A * | 8/1999 | Granger | 83/334 |
| 6,363,825 | B1 | 4/2002 | Hagleitner | |
| 6,457,394 | B1 * | 10/2002 | Granger | 83/649 |
| 6,460,798 | B1 * | 10/2002 | Haen et al. | 242/560 |
| 7,500,420 | B2 * | 3/2009 | Cvjetkovic et al. | 83/649 |
| 2001/0045149 | A1 * | 11/2001 | Granger | 83/335 |

FOREIGN PATENT DOCUMENTS

| | | | |
|---|---|---|---|
| DE | 2814792 | A1 | 10/1978 |
| DE | 3690545 | T0 | 12/1987 |
| EP | 11262 | A * | 5/1980 |
| EP | 526357 | A1 * | 2/1993 |
| FR | 2340887 | A2 | 9/1977 |
| FR | 2764498 | A1 | 12/1998 |
| GB | 2007623 | A * | 5/1979 |
| WO | 9740731 | A1 | 11/1997 |

* cited by examiner

*Primary Examiner* — Kenneth E. Peterson
*Assistant Examiner* — Jennifer Swinney
(74) *Attorney, Agent, or Firm* — Laurence A. Greenberg; Werner H. Stemer; Ralph E. Locher

(57) ABSTRACT

A device for the distribution of paper portions has a rotatable roller which is formed with a slot and over which a paper web is guided. A blade which is arranged on at least one carrier movable within the roller and is movable in and out through the slot over a part of the roller rotation. Each carrier is reciprocatable in the slot of the rotating roller and is guided rotationally along a non-circular stationary cam path.

5 Claims, 5 Drawing Sheets

BLADE GUIDE FOR A DEVICE FOR DISPENSING OF PAPER SECTIONS

CROSS-REFERENCE TO RELATED APPLICATION

This application claims the priority, under 35 U.S.C. §119, of Austrian patent application A968/2009, filed Jun. 23, 2009; the prior application is herewith incorporated by reference in its entirety.

BACKGROUND OF THE INVENTION

Field of the Invention

The invention relates to a device for the distribution of paper portions, comprising a rotatable cutting roller which has a slot and over which a paper web is guided, and a blade which is arranged at a carrier that is movable within the cutting roller and is controlled by means of at least one non-circular cam path fixed with respect to the device, in such a way that it moves out and in through the slot only over a part of the roller rotation, with the paper being cut.

Such devices which are used in particular as paper towel dispensers in bathrooms are known in various design configurations for example from U.S. Pat. No. 4,186,633 and its counterpart German published patent application DE 28 14 792 A1. There, there is disclosed (cf. FIGS. 10, 11) a design in which the blade is rotatably mounted on a shaft parallel to the roller axis and, guided by the slot in the wall of the roller, is rotated about the shaft. In that case by virtue of the varying axis spacing over a partial region of the rotation of the roller the blade issues at the roller. In FIGS. 12 and 13 of U.S. Pat. No. 4,186,633 and DE 28 14 792 A1, the blade projects approximately perpendicularly from the carrier, giving an overall shape which is hook-like in an end view. The carrier comprises two arms which are pivotally mounted about a common axis near the peripheral wall of the roller in a respective end wall of the roller. When the roller is rotated the blade moves on a circular arc through the slot, in which case either the carrier bears against a stationary cam disk or it is guided by a crank arm mounted on a stationary axis parallel to the axis of the roller.

The blade guide in accordance with U.S. Pat. No. 4,712,461 (German patent DE 36 90 545) includes a slider which is displaceable on a diameter of the roller and on which the blade is arranged parallel to the direction of displacement and is moved outwardly in a straight line through the slot.

Two other designs are described in my earlier U.S. Pat. No. 6,363,825 B1 and its counterpart international patent application publication WO 97/40731. There, the blade is, on the one hand, pivotally mounted to the carrier and, on the other hand, either displaceable in a sliding guide or pivotally mounted to a second link member.

Depending on the strength and elasticity of the paper web which is to be cut and which is guided over an entry pressure roller, the blade roller and an approximately diametrically oppositely disposed exit pressure roller, it can happen that the blade itself, even if it is toothed, does not cut the paper web but only lifts it off the blade roller.

SUMMARY OF THE INVENTION

It is accordingly an object of the invention to provide a device for dispensing paper sections which overcomes the above-mentioned disadvantages of the heretofore-known devices and methods of this general type and which provides for an easily movable blade guide which is as simple as possible and by which the blade tensions the paper web in such a way that it reliably penetrates into the paper web. In that respect the blade is to be pushed out and drawn in again in a first part of the roller rotation and remains drawn-in in the remaining second part of the roller rotation.

With the foregoing and other objects in view there is provided, in accordance with the invention, a blade guide for a device for the distribution of paper portions, the device having a rotatable cutting roller for guiding a paper web, the cutting roller having a slot formed therein, and a carrier movably disposed in the cutting roller and a blade mounted to the carrier. The blade guide is configured for cutting the paper web during a rotation of the cutting roller, and the blade guide comprising:

a non-circular cam path fixed with respect to the device inside said cutting roller for controlling a movement of said carrier, to move said blade in and out through said slot only over a part of the rotation of said cutting roller and to thereby cut the paper; and a displacement guide disposed in said slot of said cutting roller;

wherein, during a rotation of said cutting roller, said carrier rotates in said non-circular cam path and is guided in said displacement guide in said slot.

In other words, the objects of the invention are achieved in that a displacement guide is provided in the slot and during the roller rotation the carrier rotates on the one hand in the cam path and on the other hand is guided in the displacement guide of the slot. The double non-parallel guidance for the carrier avoids pivotal movement of the carrier about an axis and, in dependence on the shape of the carrier and the arrangement or configuration of its two guides, the blade cutting edge can easily perform a movement leading the periphery of the roller as the exit angle of the blade changes although the carrier is in one piece.

The displacement guide in the slot of the roller extends substantially parallel to the slot and substantially from the inside outwardly. The guide surfaces can be flat or curved. By virtue of the non-circular cam path the carrier pivots over a given range during guidance in the slot and in a preferred configuration can roll in the slot against a further guide surface. In this case a frictional relationship but in particular a positively locking relationship can be provided. Preferably therefore the further guide surface can also have a tooth assembly into which a toothed region of the carrier engages. That reduces the play not only in the two guides, in particular in the critical portions of the cam paths, in which it extends at least approximately parallel to the displacement guide, but that also ensures a precise pivotal movement of the blade, by means of which the movement of the blade cutting edge, that leads the roller periphery, and a maximum depth of penetration of the blade teeth into the paper web, is achieved.

In a preferred embodiment it is provided that the carrier has two side portions which together with the blade form approximately an L-shape, wherein provided at the free inner end of the L-shape is a first guide element for engagement into the cam path and provided at the apex of the L-shape is a second guide element for engagement into the displacement guide of the slot.

Other features which are considered as characteristic for the invention are set forth in the appended claims.

Although the invention is illustrated and described herein as embodied in a blade guide for a device for dispensing paper sections, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 9:
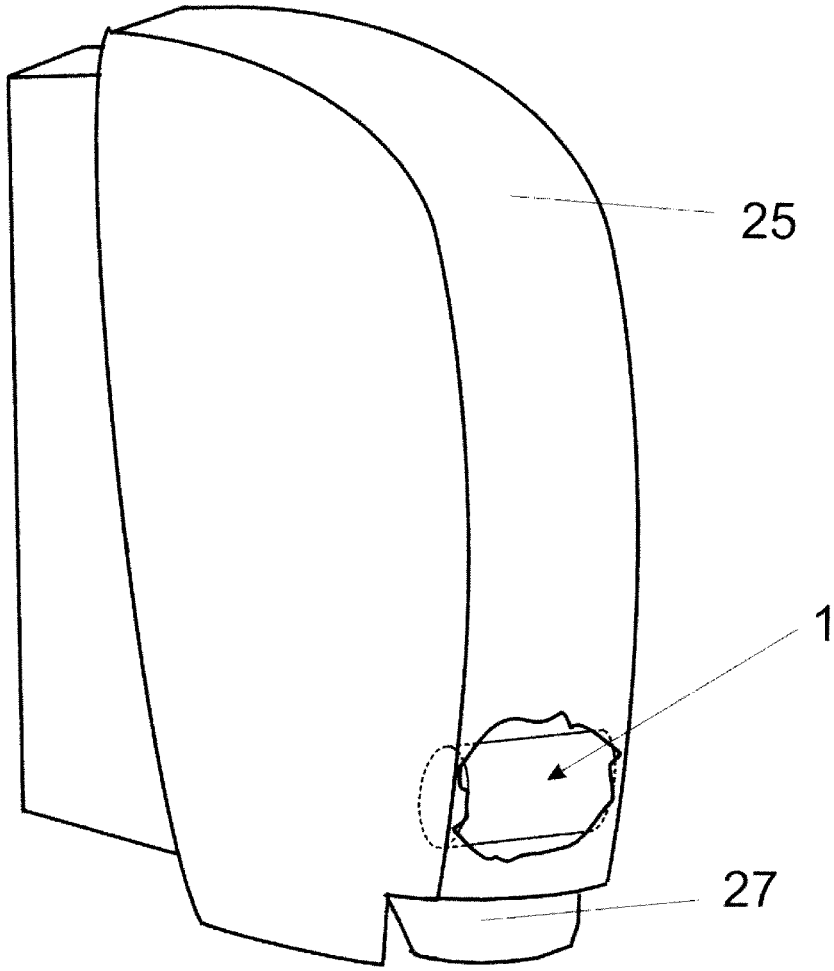
FIG. 9 is a diagrammatic perspective view of a partly broken-away paper dispenser.

Referring now to the figures of the drawing in detail, FIG. 9 shows an exemplary embodiment in the form of a device for the distribution of paper portions, for example a paper towel dispenser. The device has a housing 25 in which a roll of paper and preferably also a reserve roll are disposed. A cutting roller 1 is provided in the lower region. The cutting roller 1 is composed of two semi-rollers 21, 22 and is indirectly drivable by motor or manually. An actuating element 27 for manual drive is arranged at the underside. If the manual drive is only provided as an auxiliary drive a motor drive can be disconnected at the same time.

Figure 1:
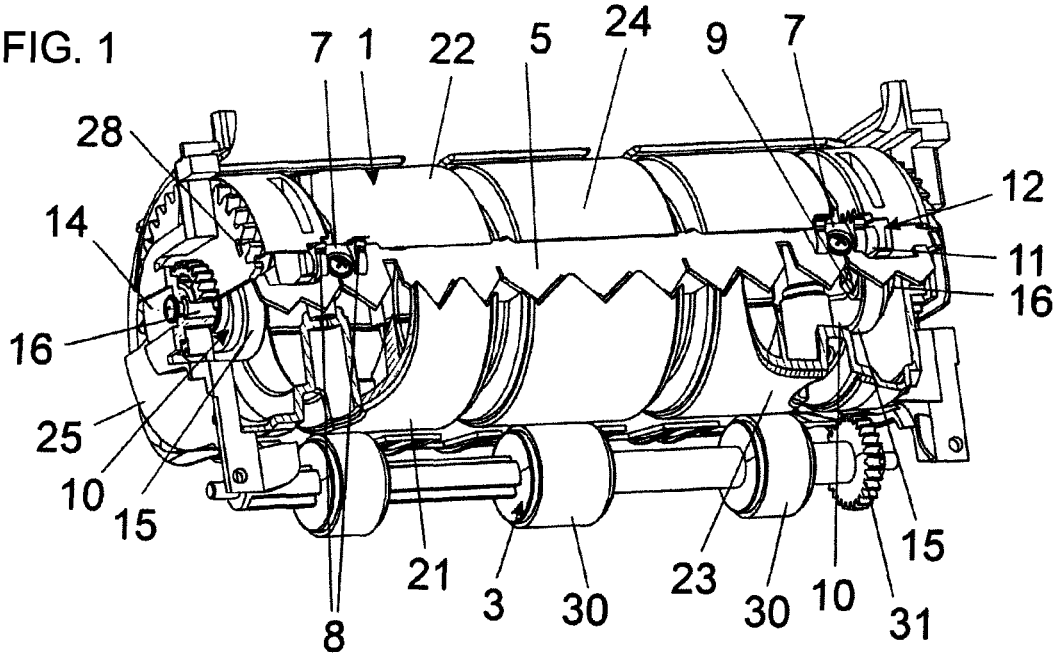
FIG. 1 shows a perspective view of a cutting device with blade guide.
Figure 2:
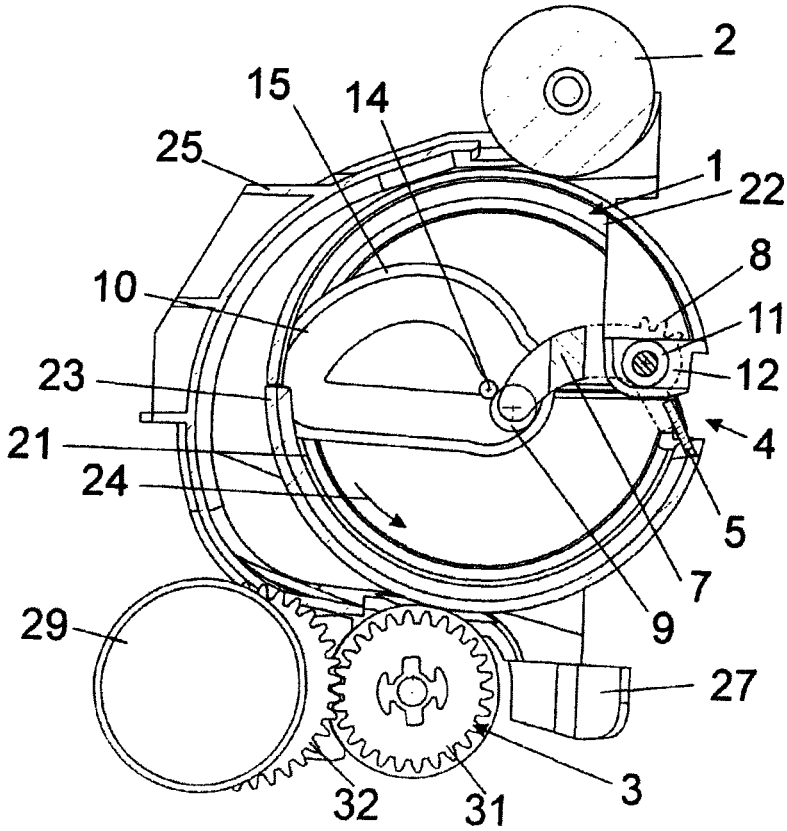
FIGS. 2 through 6 respectively show turned diagrammatic end views of the cutting device.
Figure 3:
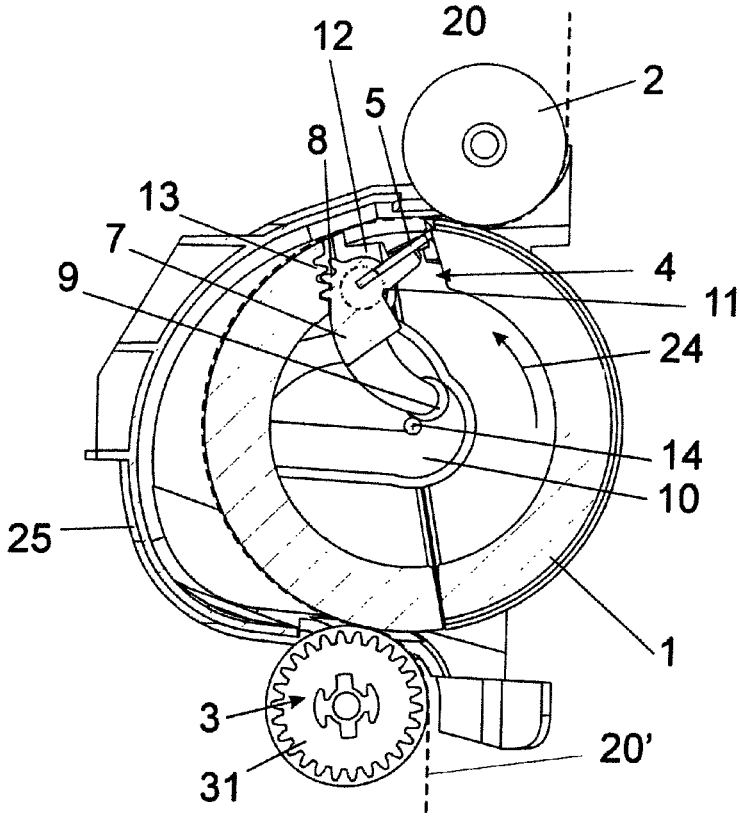

The uncut paper web 20 (see, FIG. 3) is fed from a supply roll by way of an entry pressure roller 2 to the cutting roller 1 rotatable about an axis 14. The paper web 20 passes well around half the periphery of the cutting roller and passes over the exit pressure roller 3 to the removal location. As can be seen from FIGS. 1 and 2 the exit pressure roller 3 is provided with a gear 31 which is driven by way of an intermediate gear 32 with an electric motor 29 only diagrammatically shown in FIG. 2. The exit pressure roller 3 has axially spaced pressure ring members 30 which press against the cutting roller 1 and convey the paper web 20. The pressure force applied by the exit pressure roller 3 and the encirclement around the cutting roller 1 over half the periphery thereof ensures the rotary movement of the cutting roller 1 which is thus only indirectly driven by the electric motor 29. The paper portions 20' are cut off the paper web 20 by means of an especially toothed blade 5 (FIG. 1). For that purpose, during the rotation of the cutting roller 1, the blade 5 which also rotates therewith is pushed out of the cutting roller 1 through a slot 4 extending parallel to the axis 14, in which case the blade cutting edge moves along a path 6 which is curved in the direction of rotation of the roller (see FIG. 7) in leading relationship with respect to the periphery of the cutting roller 1. Depending on the respective elasticity, stretchability and strength the paper web 20 is lifted to a greater or lesser extent off the cutting roller 1 and in so doing is increasingly tensioned between the entry pressure roller 2 and the cutting roller 1 on the one hand and the exit pressure roller 3 and the cutting roller 1 on the other hand by the blade teeth which are pushed out of the cutting roller 1 in opposite relationship to the direction of rotation 24 of the roller, until the teeth cut thereinto, in which case the exit angle of the blade changes and the teeth penetrate completely into the paper web 20. The blade guide required for that purpose includes a carrier which has two side portions 7 which are reciprocatingly displaceable in the slot 4 of the cutting roller 1 and which are guided in rotational relationship along two end, non-circular cam paths 10 and to which the blade 5 is fixed projecting approximately at a right angle. The two side portions 7 are of mirror image configurations. At the inner end each side portion 7 has a first guide element 9, in particular a rotatably mounted roller, which engages into the cam path 10 which is provided on an element 15 that is mounted within the cutting roller 1 and non-rotatably connected to the side wall of the housing 25. Thereby, the total axial length of the cutting roller 1 and its mounting that cause the width of the housing 25 is as short as possible.

As mentioned the cutting roller 1 preferably includes two semi-rollers 21, 22 which after insertion of the cutting mechanism are joined together, for example by screw means, in which case the semi-rollers 21, 22 supplement each other at the ends to constitute bearing bushes mounted on trunnions 16, to which the elements 15 are fixed. In that way the cam paths 10 are provided in the interior of the cutting roller 1.

Figure 4:
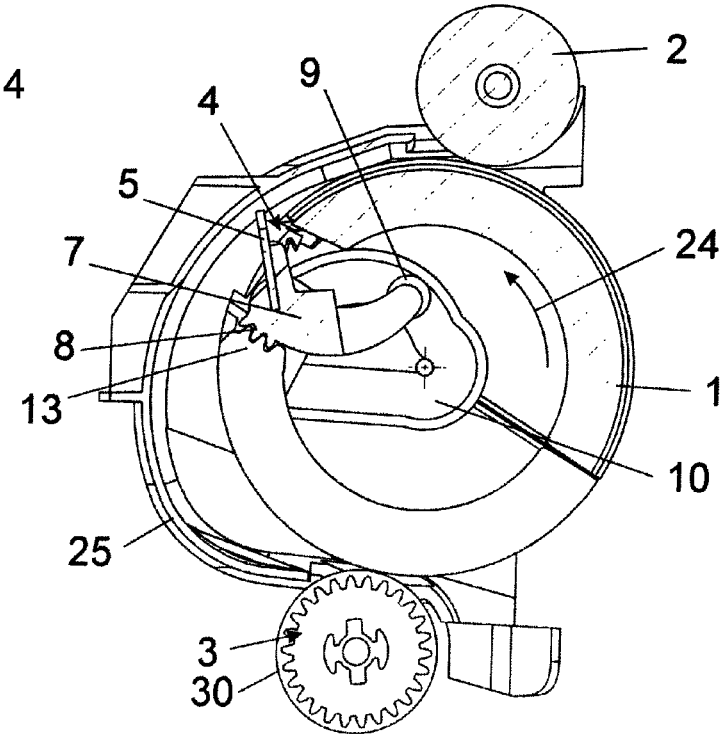
Figure 7:
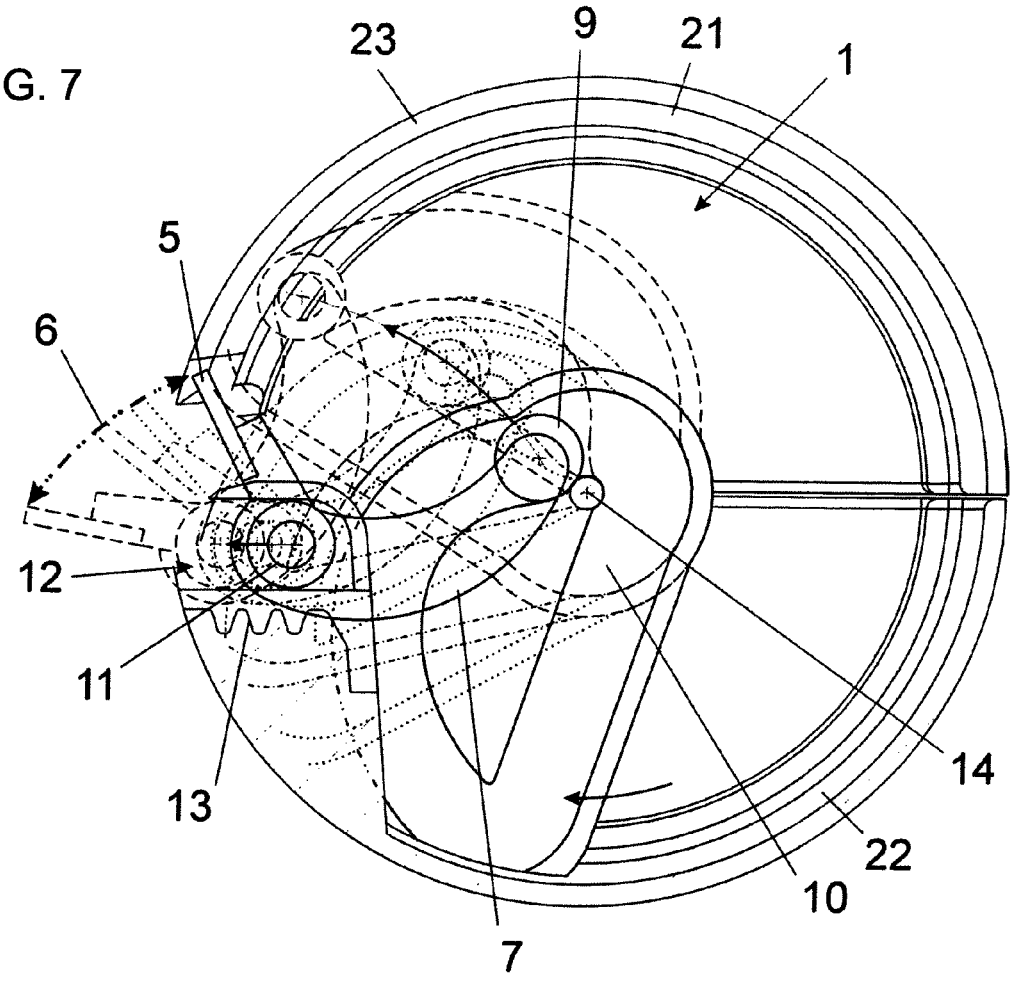
FIG. 7 shows a diagrammatic end view showing four different positions of the blade movement.
Figure 8:
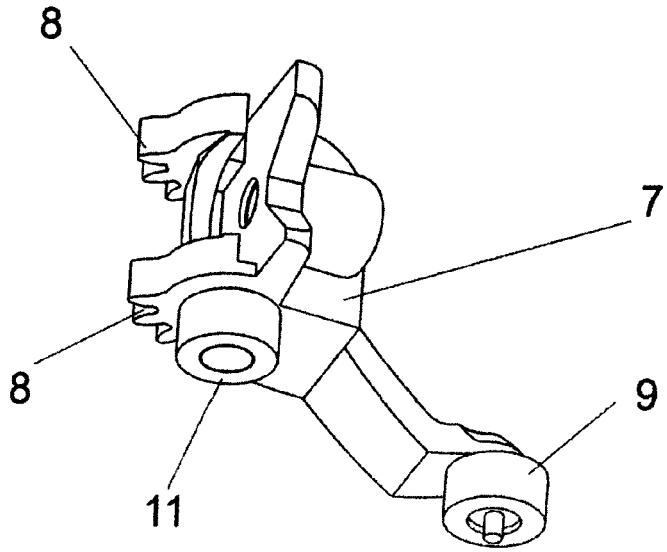
FIG. 8 shows a perspective view of a blade carrier.

Each side portion 7 has a second pin-shaped guide element 11 which engages into a substantially straight or slightly curved displacement guide 12 provided in the form of a guide path at one of the two semi-rollers 21, 22 in such a way that it extends in the slot 4. Each side portion 7 is further provided at the end nearer the second guide element 11 with a tooth assembly 8 which for example has three teeth arranged concentrically relative to the pin-shaped guide element 11. The teeth engage into a tooth assembly 13 provided at a further guide surface of the two semi-rollers 21, 22 and delimits the slot 4 of the assembled cutting roller 1 at one side. Preferably the tooth assemblies 8, 13, which mesh with one another are provided in mutually parallel doubled relationship to increase the guidance and stability of the two side portions 7 of the carrier during the outward and inward movement. When the cutting roller 1 is rotated in the direction of the arrow 24 the two side portions are displaced, as can be seen from FIGS. 2 through 6, by virtue of the non-parallel guidance effect in the cam path 10 and the displacement guide 12 in the slot 4, wherein the two side portions 7 roll in the tooth arrangements 13 and the blade 5 is pivoted outwardly. In that case the blade tips move along the path 6 shown in FIG. 7. There, FIG. 7 shows the blade movement when the cutting roller 1 is held fast and the bearing elements 15 are rotated with the cam paths 10 about the roller axis 14 in the direction of the arrow. The cam path 10 has a portion which embraces somewhat over 180° at the roller axis 14 in concentric relationship therewith so that the blade remains in the retracted position shown in FIG. 2 between the exit pressure roller 3 and the entry pressure roller 2. After passing the entry pressure roller 2 the first guide element 9 passes into a curved portion of the cam path, the spacing of which relative to the roller axis 14 increases whereby the side portions 7 of the carrier are displaced in the guide path 12 and roll in the tooth arrangement 13 so that the blade moves out of the position shown in FIG. 3 into the position shown in FIG. 4 and finally into the position of FIG. 5 in which the blade 5 is furthest extended and pivoted outwardly. In that case the movement of the blade cutting edge is in leading relationship with the rotation of the roller so that cutting of the paper web 20 is ensured after the blade tips penetrate thereinto as the tension in the paper web increases.

Figure 5:
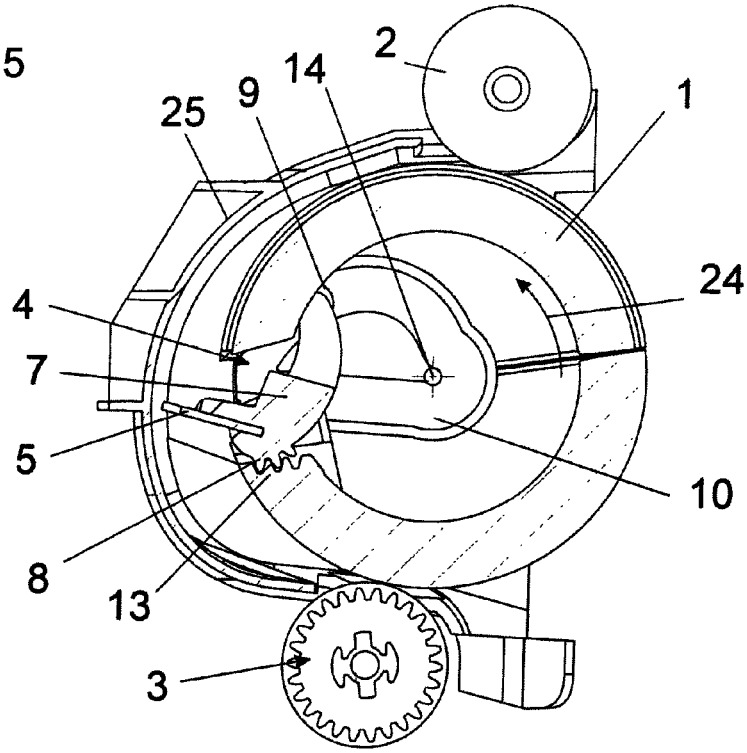
Figure 6:
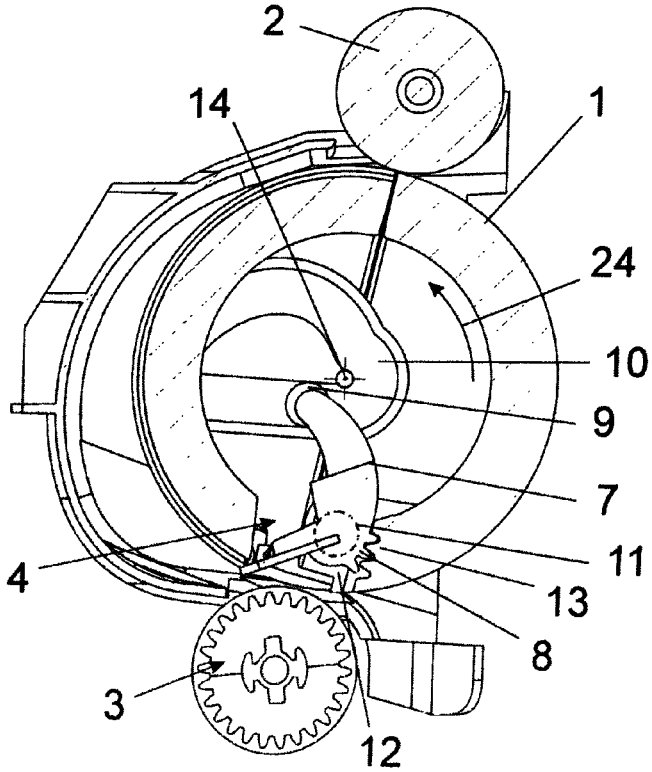

The cam path 10 moves out of the position shown in FIG. 5 approximately in a straight line back into the concentric portion (FIG. 6), whereby the blade 5 is retracted again in the remaining 60° of the roller rotation to the exit pressure roller 3. The paper portion 20' can then be removed at the underside of the housing 25. The drive of the exit pressure roller 3 is effected by motor means and in particular in contact-less mode, in which case the motor 29 and, if necessary, the exit pressure roller 3 can be disconnected for emergency operation by hand. The emergency operation by hand is effected by way of an actuating lever 27 at the lower end of the housing, or by pulling on the projecting end of the paper web, as the case may be. The described blade guide is the same in all cases. The tooth arrangements 8, 13 promote flowing movements of the side portions 7, wherein the rolling off movement necessarily arises out of the non-parallel double guidance effect in the cam path 10 and the displacement guide 12.

In the illustrated embodiment the blade 5 is respectively held in the end region only at the two side portions 7. To increase stability the two side portions 7 can also have an additional longitudinal connection so that for example the two side portions form side limbs of an approximately U-shaped carrier loop, to which the blade 5 can be secured at a plurality of locations.

The entry pressure roller 2 has a friction-enhancing peripheral surface, in particular a rubber coating formed at least by a plurality of rings.

As already mentioned the blade 5 is toothed to make it easier to cut the paper web so that it firstly digs into the paper with a row of points. The region of the peripheral surface, that follows the slot 4 in the cutting roller 1, is provided with a rubber layer 23 so that after passing the slot 4 the paper web 20 is clamped between the entry pressure roller 2 and the rubber layer 23. As soon as the teeth of the blade 5 have dug into the paper web 20 the tension in the paper web 20 increases. That is additionally further increased as, by virtue of the guidance for the blade 5, the cutting edge thereof issues from the slot 4 in leading relationship with the periphery of the cutting roller 1, that is to say the blade 5 accelerates in comparison with the cutting roller 1.

The exit pressure roller 3 also has a friction-enhancing peripheral surface, in particular a rubber coating formed at least by a plurality of rings. Thereby, as already mentioned, the movement of the blade is effected by the driven exit pressure roller 3 pressing the paper web against the cutting roller 1 as well as pulling forces are applied to the paper web in the conveying direction in order to avoid the end being drawn back when the blade 5 is extended out of the cutting roller.

If the paper web 20 has disadvantageous properties for the cutting effect, that is to say a high tearing strength and a high degree of stretchability, the paper web 20 would not be cut by the outwardly moving blade 5 (FIGS. 4 and 5) in spite of the teeth in the cutting edge, but would be stretched, and the portion of increased length would be laid in folds in the region as far as the exit pressure roller 3 as soon as the blade 5 is retracted again if the rubber layer 23 were to cover the entire periphery of the cutting roller 1 as the paper web 20 would also be clamped to the same extent between the exit pressure roller 3 and the cutting roller 1 and transport it. Compensation would not be possible.

In order now to ensure that the cutting action does not fail to occur and to avoid the paper being crumpled, each half 22 of the cutting roller 1, preceding the slot 4, is provided with a surface whose friction in relation to the paper web 20 is lower than the friction of the surfaces of both pressure rollers 2, 3 and the half 21 of the cutting roller 1, that follows the slot 4. The paper can slide on the surface of lower friction and a portion of increased length of the paper web 20, that occurs due to stretching, is directly compensated as the tensile forces tension the paper web without also rotating the cutting roller 1 until the increased-length portion has been pulled out. In other words the cutting roller 1 rotates only by the corresponding arc-length due to the pull applied to the paper, although a paper portion 20' which has been increased in size by the stretch is dispensed. Cutting reliability 1 is improved, even if the cutting edge becomes blunter after prolonged use.

In that respect a mechanical paper dispenser can completely cut through the paper web in that way as the user when handling the actuation lever 27 can hold the end of the paper in his hand. In the case of a dispenser which is driven by motor means and in particular in contact-less fashion it is preferably provided that the cut leaves at least a small connecting region between the paper portion 20' and the paper web 20, which tears without perceptible resistance upon being adopted by the user, but prevents the paper portion 20' from dropping on to the ground.

In the case of the paper dispenser which is driven contactlessly by motor means, a marking 28, a permanent magnet or the like is further preferably provided at a location on the roller, to be able to exactly predetermine identical blade positions in each distribution process, which are sensed with suitable sensors on the housing as the length which varies due to stretch cannot be used for exact measurement.

The invention claimed is:

1. A blade guide for a device for the distribution of paper portions, the device having a rotatable cutting roller for guiding a paper web, the cutting roller having a slot formed therein, and a carrier movably disposed in the cutting roller and a blade mounted to the carrier, the blade guide being configured for cutting the paper web during a rotation of the cutting roller, said blade guide comprising:

a non-circular cam path fixed with respect to the device inside said cutting roller for controlling a movement of said carrier, to move said blade in and out through said slot only over a part of the rotation of said cutting roller and to thereby cut the paper; and a displacement guide defined by a wall of said slot of said cutting roller;

during a rotation of said cutting roller, said carrier rotating in said non-circular cam path and being guided in said displacement guide in said slot;

said carrier being so guided in said slot to also roll against said wall of said slot.

2. The blade guide according to claim 1, wherein said wall of said slot and a rolling portion of said carrier have mutually meshing tooth assemblies.

3. The blade guide according to claim 1, wherein said carrier has two side portions which, together with said blade, form approximately an L-shape, and wherein a first guide element is provided at a free inner end of the L-shape for engagement into said cam path and a second guide element is provided at an apex of the L-shape for engagement into said displacement guide of said slot.

4. The blade guide according to claim 1, wherein, in a rest position, said blade lies with an acute angle in opposite relationship to a direction of rotation of said roller within a peripheral surface and, during the roller rotation, pivots upwardly out of the peripheral surface, with an increase in the angle.

5. A device for the distribution of paper portions, comprising:

a rotatable cutting roller for guiding a paper web, said cutting roller having a slot formed therein;

a carrier movably disposed in said cutting roller and a blade mounted to said carrier;

a blade guide for cutting the paper web during a rotation of said cutting roller, said blade guide including:

a non-circular cam path fixed with respect to the device inside said cutting roller for controlling a movement of said carrier, to move said blade in and out through said slot only over a part of the rotation of said cutting roller and to thereby cut the paper; and a displacement guide defined by a wall of said slot of said cutting roller;

during a rotation of said cutting roller, said carrier rotating in said non-circular cam path and being guided in said displacement guide in said slot;

said carrier being so guided in said slot to also roll against the wall of said slot.

* * * * *